US007913319B1

(12) United States Patent
Iannace

(10) Patent No.: US 7,913,319 B1
(45) Date of Patent: Mar. 29, 2011

(54) DISPOSABLE SINGLE USE, AND SHAPE-RETAINING PAD FOR PROTECTING A KNEE

(76) Inventor: Christopher Iannace, Staten Island, NY (US)

( * ) Notice: Subject to any disclaimer, the term of this patent is extended or adjusted under 35 U.S.C. 154(b) by 75 days.

(21) Appl. No.: 11/254,194

(22) Filed: Oct. 19, 2005

(51) Int. Cl.
*A41D 13/00* (2006.01)

(52) U.S. Cl. ..... 2/24

(58) Field of Classification Search ..... 2/455, 22, 2/23, 24, 267, 62, 247, 49.4, 49.5, 911
See application file for complete search history.

(56) References Cited

U.S. PATENT DOCUMENTS

| | | | | |
|---|---|---|---|---|
| 588,907 | A | 8/1897 | Herbelin | |
| 4,014,046 | A | 3/1977 | Craig | |
| 4,765,482 | A | 8/1988 | Delia | |
| 4,884,299 | A | 12/1989 | Rose | |
| 4,964,176 | A * | 10/1990 | Previdi | 2/242 |
| 5,077,837 | A | 1/1992 | Meistrell | |
| 5,594,954 | A | 1/1997 | Huang | |
| 5,809,568 | A | 9/1998 | Morris-Jones | |
| 5,845,333 | A | 12/1998 | Crampton | |
| 5,896,580 | A | 4/1999 | Aldrich et al. | |
| 5,920,902 | A | 7/1999 | Crampton | |
| 6,014,771 | A | 1/2000 | Kirven | |
| 6,049,906 | A * | 4/2000 | Aldridge | 2/23 |
| 6,353,939 | B1 | 3/2002 | Arber | |
| 6,401,245 | B1 | 6/2002 | Slautterback | |
| 6,425,135 | B1 * | 7/2002 | Aldrich | 2/23 |
| 6,553,573 | B1 | 4/2003 | Brown | |
| 2002/0138896 | A1 | 10/2002 | Holden | |
| 2003/0172441 | A1 | 9/2003 | Foster et al. | |

* cited by examiner

*Primary Examiner* — Tejash Patel
(74) *Attorney, Agent, or Firm* — Richard L. Miller

(57) ABSTRACT

A disposable, single use, and shape-retaining pad for protecting a knee of a user. The pad includes a first layer and a second layer. A first layer is attached to a second layer by an adhesive and provides comfort for the knee of the user during kneeling. The second layer allows the disposable, single use, and shape-retaining pad to maintain the kneeling shape of the knee of the user after the user has kneeled to prevent the disposable, single use, and shape-retaining pad from popping back and off the knee of the user when the user is no longer kneeling. The first layer is a sheet of foam material and the second layer is a sheet of metallic foil.

9 Claims, 1 Drawing Sheet

DISPOSABLE SINGLE USE, AND SHAPE-RETAINING PAD FOR PROTECTING A KNEE

BACKGROUND OF THE INVENTION

1. Field of the Invention

The present invention relates to a knee pad, and more particularly, the present invention relates to a disposable, single use, and shape-retaining pad for protecting a knee.

2. Description of the Prior Art

Numerous innovations for body protectors have been provided in the prior art that will be described. Even though these innovations may be suitable for the specific individual purposes to which they address, however, they differ from the present invention.

A FIRST EXAMPLE, U.S. Pat. No. 588,907, Issued on Aug. 24, 1897, to Herbelin teaches a leg-protector, the combination with the leg portion A, having an extension at the top thereof reaching to the waist of the wearer and a belt passing through the said extension and supporting the said leg portion, and a plurality of buttons secured upon the outside of the front of the said leg portion; of a flexible reinforcement provided with a plurality of holes adapted to engage the said buttons; a concavo-convex casing secured to the said flexible reinforcement, and a padding filling the concavity of said casing substantially as described.

A SECOND EXAMPLE, U.S. Pat. No. 4,014,046, Issued on Mar. 29, 1977, to Craig teaches a plurality of disposable cuff protectors formed consecutively on a double layer roll of sheet material, by releasably sealing the sheets together along narrow transversely running linear area axially disposed along said sheets. A perforated tear line is disposed within each releasable sealing area for individually separating the cuff protectors one from another. The linear sealing areas are disposed along said sheet with a first plurality of parallel areas placed at an angle to the edge of the sheets, and a second plurality of parallel linear sealing areas intermediate said first sealing areas placed at an angle to said sheet edge and at an angle to said first areas forming cuff protectors having a narrow opening at one end and a wide opening at the other end.

A THIRD EXAMPLE, U.S. Pat. No. 4,765,482, Issued on Aug. 23, 1988, to Delia teaches a pad dispenser for moistened treatment pads including a wide mouth container and a pad elevator which is receivable within the container. The pad elevator has a generally planar pad support platform to whose periphery are joined a plurality of spaced, resilient collets. A generally vertically directed grasping stem is formed in the middle of the platform. A plurality of treatment pads or disks are positionable in a generally on edge array on the pad elevator's platform. Access to these pads is afforded by raising of the pad elevator within the container. Once raised, the pad elevator will be maintained in its elevated position by a sliding interference fit between the elevator collets and the container sidewall.

A FOURTH EXAMPLE, U.S. Pat. No. 4,884,299, Issued on Dec. 5, 1989, to Rose teaches disposable baby bibs, related packaging, and unique tabs to affix said disposable bibs to infants or adults.

A FIFTH EXAMPLE, U.S. Pat. No. 5,077,837, Issued on Jan. 7, 1992, to Meistrell teaches a knee or elbow protector apparatus for application to an athlete's leg or arm, comprising a flexible, relatively thin wall tube that is bidirectionally stretchable, the tube having inner and outer sides, and opposite ends and sides to be stretched when slipped onto the leg or arm to cover the knee or elbow, the tube including a first elastomeric layer and a second layer of stretchable fabric attached to and substantially covering one side of the first layer; an elastomeric foam pad located adjacent the outer side of the tube and spaced from the opposite side; and retention fabric closely covering the pad and defining a loop-shaped peripheral portion that is attached to the tube.

A SIXTH EXAMPLE, U.S. Pat. No. 5,594,954, Issued on Jan. 21, 1997, to Huang teaches a knee-pad or an elbow-pad having a body made of a layer of lining, a layer of buffer and a surface cloth by means of thermal pressing process. The body has an intermediate, an upper and a lower portion. The intermediate portion additionally has a bowl-shaped plate on an upper surface. The upper and the lower portion respectively have plural lateral ribs on the surface, and each of the ribs has elastic means consisting of an elastic tube and soft metal wires extending in the tube, and grooves are formed between every two ribs so that the body may be easily bent or straightened according to movement of the knee of a user.

A SEVENTH EXAMPLE, U.S. Pat. No. 5,809,568, Issued on Sep. 22, 1998, to Morris-Jones teaches a disposable bib being formed from two sheets of absorbent material such as tissue paper, separated by perforations. The bibs are dispensed from a roll, with each bib being separated from the roll along a row of perforations. Alternate sheets have a flap defined by perforations. In use the flap is released from one of the sheets and folded to overlie or underlie the other sheet to provide a neck-receiving opening and a double thickness protective bib portion.

AN EIGHTH EXAMPLE, U.S. Pat. No. 5,845,333, Issued on Dec. 8, 1998, to Crampton teaches a resilient, flat closed-cell knee pad being rolled and inserted through a gap in a seam attaching edges of a patch to the knee area of a work pant. The knee pad then unrolls and fills a space between the work pant and the patch thereby protecting a wearer's knee when kneeling.

A NINTH EXAMPLE, U.S. Pat. No. 5,896,580, Issued on Apr. 27, 1999, to Aldrich et al. teaches a multi-layer knee pad construction for attachment to the interior surface of the knee portion of a pair of pants. The construction includes an outer waterproof layer, an inner low friction layer and an intermediate padded layer operatively connected to one another and the interior surface of the pair of pants by a plurality bonding layers.

A TENTH EXAMPLE, U.S. Pat. No. 5,920,902, Issued on Jul. 13, 1999, to Crampton teaches a flexible closed-cell knee pad being held in place between the inside of the knee area of work pant leg and a rectangular fabric piece that is glued to pant leg. Since the fabric is attached to the pant leg by adhesive it is easy to install the knee pad on any kind of work pant without special tools or skills.

AN ELEVENTH EXAMPLE, U.S. Pat. No. 6,014,771, Issued on Jan. 18, 2000, to Kirven teaches a knee protection kit comprised of two separate fabric pockets, one for each knee of a pair of pants. The kit also contains a liquid fabric glue for attachment of each pocket to a corresponding pants knee area. Each pocket may be attached to the pants' exterior knee area or interior knee area. Each pocket also contains a closable flap with a fastener. The kit provides three pairs of pads, one pair made from neoprene material or the like, the second pair made from a hard, plastic shell material or the like, and the third pair made from a lambs' wool material or the like. The neoprene and plastic pads are each adapted to fit into a pocket. The lamb's wool pads are adapted to being glued to the outside of a pocket if the pocket is attached to the interior of the pants; otherwise the lamb's wool pads are attached directly to the interior of the pants in the knee area.

A TWELFTH EXAMPLE, U.S. Pat. No. 6,353,939 B1, Issued on Mar. 12, 2002, to Arber teaches a disposable one-time use legging for covering, and protecting, a lower leg of a wearer from, and capturing, ticks. The legging includes a sleeve, first bands, and a second band. The uppermost terminal end of the sleeve is formed into an upper circumferential tunnel, and the lowermost terminal end of the sleeve is formed into a lower circumferential tunnel. The first bands include an uppermost first band that is elastic and encased in the uppermost circumferential tunnel of the sleeve for maintaining the uppermost terminal end of the sleeve in position tightly and securely around, and in direct snug contact with, the lower leg of the wearer, just below the knee of the wearer so as to prevent the ticks from getting therebetween, an intermediate first band that is elastic and encased in the lowermost circumferential tunnel of the sleeve for maintaining the lowermost terminal end of the sleeve in position tightly and securely around, and in direct snug contact with, the ankle of the wearer so as to prevent the ticks from getting therebetween, and a lowermost first band that is elastic and depends from the lowermost terminal end of the sleeve so as to form a stirrup for receiving the foot of the wearer. The second band includes a strip of adhesive that extends around the sleeve for capturing the ticks attempting to excursion thereon, and a release sheet that releasably covers the strip of adhesive thereof, prior to use.

A THIRTEENTH EXAMPLE, U.S. Pat. No. 6,401,245 B1, Issued on Jun. 11, 2002, to Slautterback teaches an improved knee pad for industrial applications that require kneeling, which has an outer shell, an inner cushion pad within the shell, a laminated fabric pad against the inner cushion pad and extending beyond the ends of the shell, the fabric pad being adapted for contacting a wearer; and straps for conforming the knee pad to the shape of the wearer's knee. A method for making the knee pad is also disclosed.

A FOURTEENTH EXAMPLE, U.S. Patent Office Document No. 2002/0138896 A1 Published on Oct. 0, 2002, to Holden teaches protective attachments providing protection that removably attaches to the bottom of the foot, hands, elbow, knees, shins, and animal pads, in a snug tight fit, and that conforms to the contour of the body part covered. The side of the protective attachment worn against the body is covered with a layer of adhesive. In addition, the protective attachment of the present invention can be easily trimmed to provide a perfect fit to the user.

A FIFTEENTH EXAMPLE, U.S. Pat. No. 6,553,573 B1 Issued on Apr. 29, 2003, to Brown teaches a protector pad particularly adapted for use by volleyball players and the like comprising an outer section, a substantially flat inner section comprising a synthetic polymer, and a unitary attachment strap which, in one embodiment of the present invention, is integrally incorporated with the outer section. The attachment strap extends over the lower ⅔ of the pad such that the strap is positioned below the knee or elbow joint of the wearer, thus permitting the wearer's knee or elbow to be unrestrictedly flexed when the pad is attached. A pad according to the present invention protects the wearer's knee or elbow joint from contact with a hard surface, while simultaneously reducing friction between the pad and a contacting surface, permitting the wearer's elbow or knee to easily slide when the padded joint contacts the ground or other hard surface.

A SIXTEENTH EXAMPLE, U.S. Patent Office Document No. 2003/0172441 Published on Sep. 18, 2003, to Foster et al. teaches Disposable Lawn Trimming Booties being designed to protect one's shoes, lower pant legs, and feet from getting dirty while using a lawn trimmer, push mower, or working in muddy/dirty conditions. The Booties can also be used to prevent dirty shoes from spreading the dirt and grime that is attached to them. The Disposable Lawn Trimming Booties are available in a variety of colors, preferably orange or yellow, for visibility safety. The Disposable Lawn Trimming Booties are made from Dupont Tyvek for durability.

It is apparent that numerous innovations for body protectors have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, it is an object of the present invention to provide a disposable, single use, and shape-retaining pad for protecting a knee that avoids the disadvantages of the prior art.

Briefly stated, another object of the present invention is to provide a disposable, single use, and shape-retaining pad for protecting a knee of a user. The pad includes a first layer and a second layer. A first layer is attached to a second layer by an adhesive and provides comfort for the knee of the user during kneeling. The second layer allows the disposable, single use, and shape-retaining pad to maintain the kneeling shape of the knee of the user after the user has kneeled to prevent the disposable, single use, and shape-retaining pad from popping back and off the knee of the user when the user is no longer kneeling. The first layer is a sheet of foam material and the second layer is a sheet of metallic foil.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

Figure 1:
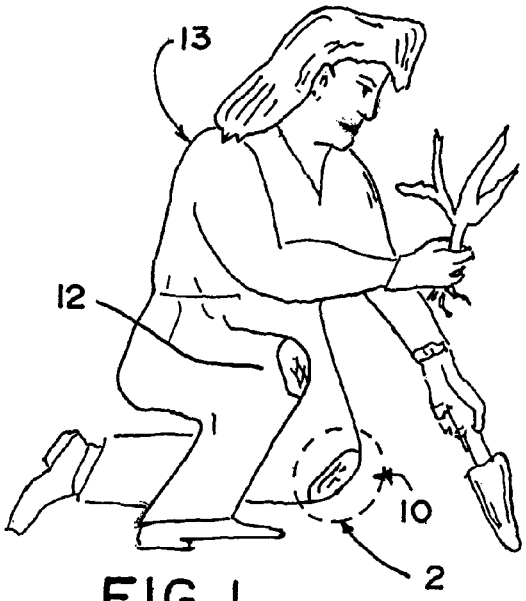
FIG. 1 is a diagrammatic perspective view of the disposable, single use, and shape-retaining pad of the present invention protecting a knee.

Preferred Embodiment 10 disposable, single use, and shape-retaining pad of present invention for protecting knee 12 of user 13

12 knee of user 13

-continued

| Preferred Embodiment | |
|---|---|
| 13 | user |
| 14 | first layer for providing comfort for knee 12 of user 13 during kneeling |
| 16 | second layer for allowing disposable, single use, and shape-retaining pad 10 to maintain kneeling shape of knee 12 of user 13 after user 13 has kneeled to prevent disposable, single use, and shape-retaining pad 10 from popping off knee 12 of user 13 when user 13 is no longer kneeling |
| 18 | first layer of adhesive |
| 20 | second layer of adhesive for releasably attaching disposable, single use, and shape-retaining pad 10 to knee 12 of user 13 |
| 22 | release sheet |
| 24 | sheet of foam material of first layer 14 |
| 26 | sheet of metallic foil of second layer 16 |
| 28 | single sheet of release sheet 22 |

| Alternate Embodiment | |
|---|---|
| 110 | disposable, single use, and shape-retaining pad |
| 122 | release sheet |
| 128 | roll of release sheet 122 |
| 130 | weakened tear off lines across roll 128 of release sheet 122 |

DETAILED DESCRIPTION OF THE PREFERRED EMBODIMENT

Figure 2:
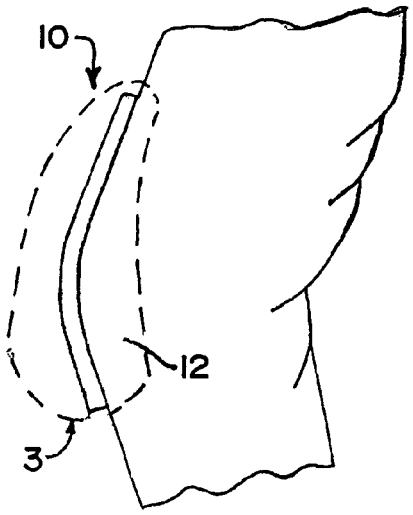
FIG. 2 is an enlarged diagrammatic side elevational view of the area generally enclosed by the dotted curve identified by ARROW 2 in FIG. 1.

Referring now to the figures, in which like numerals indicate like parts, and particularly to FIGS. 1 and 2, which are, respectively, a diagrammatic perspective view of the disposable, single use, and shape-retaining pad of the present invention protecting a knee, and, an enlarged diagrammatic side elevational view of the area generally enclosed by the dotted curve identified by ARROW 2 in FIG. 1, the disposable, single use, and shape-retaining pad of the present invention is shown generally at 10 for protecting a knee 12 of a user 13, wherein the knee 12 of the user 13 has a kneeling shape when the user 13 is kneeling.

Figure 4:
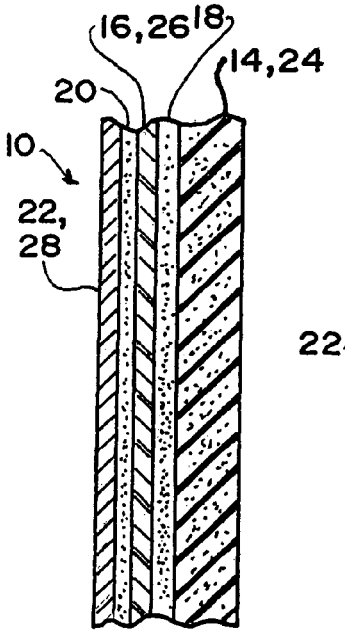
FIG. 4 is an enlarged diagrammatic cross sectional view taken along LINE 4-4 in FIG. 4.
Figure 3:
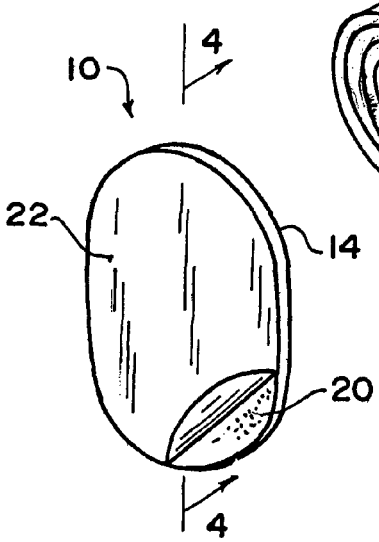
FIG. 3 is a diagrammatic perspective view of the area generally enclosed by the dotted curve identified by ARROW 3 in FIG. 2 of the disposable, single use, and shape-retaining pad of the present invention.

The configuration of the disposable, single use, and shape-retaining pad 10 can best be seen in FIGS. 3 and 4, which are, respectively, a diagrammatic perspective view of the area generally enclosed by the dotted curve identified by ARROW 3 in FIG. 2 of the disposable, single use, and shape-retaining pad of the present invention, and, an enlarged diagrammatic cross sectional view taken along LINE 4-4 in FIG. 4, and as such, will be discussed with reference thereto.

The disposable, single use, and shape-retaining pad 10 comprises a first layer 14 and a second layer 16. The first layer 14 is attached to the second layer 16 and is for providing comfort for the knee 12 of the user 13 during kneeling. The second layer 16 is for allowing the disposable, single use, and shape-retaining pad 10 to maintain the kneeling shape of the knee 12 of the user 13 after the user 13 has kneeled to prevent the disposable, single use, and shape-retaining pad 10 from popping back and off the knee 12 of the user 13 when the user 13 is no longer kneeling.

The first layer 14 is attached to the second layer 16 by a first layer of adhesive 18.

The second layer 16 has a second layer of adhesive 20 thereon. The second layer of adhesive 20 is on a side of the second layer 16, which is opposite to that of the first layer of adhesive 18 and is for releasably attaching the disposable, single use, and shape-retaining pad 10 to the knee 12 of the user 13.

The second layer of adhesive 20 is covered by a release sheet 22. The release sheet 22 protects the second layer of adhesive 20 prior to use of the disposable, single use, and shape-retaining pad 10 and peels off the second layer of adhesive 20 when the disposable, single use, and shape-retaining pad 10 is to be used.

The first layer 14 is a sheet of foam material 24. The second layer 16 is a sheet of metallic foil 26. The release sheet 22 is a single sheet 28.

Figure 5:
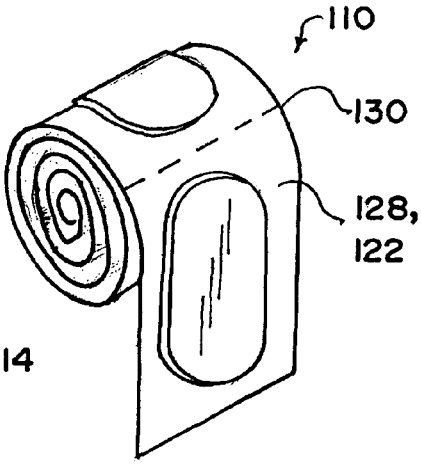
FIG. 5 is a diagrammatic perspective view of an alternate embodiment of the disposable, single use, and shape-retaining pad of the present invention.

An alternate embodiment of the disposable, single use, and shape-retaining pad 110 can best be seen in FIG. 5, which is a diagrammatic perspective view of an alternate embodiment of the disposable, single use, and shape-retaining pad of the present invention, and as such, will be discussed with reference thereto.

The disposable, single use, and shape-retaining pad 110 is similar to the disposable, single use, and shape-retaining pad 10, except that the release sheet 122 is not a single sheet but rather a roll 128 to allow multiple disposable, single use, and shape-retaining pads 110 to share the same roll 128. The roll 128 of the release sheet 122 is provide with weakened tear off lines 130 thereacross to allow each individual disposable, single use, and shape-retaining pad 110 to be torn off the roll 128 as needed.

It will be understood that each of the elements described above, or two or more together, may also find a useful application in other types of constructions differing from the types described above.

While the invention has been illustrated and described as embodied in a disposable, single use, and shape-retaining pad for protecting a knee, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disposable, single use, and shape-retaining pad for protecting a knee of a user, wherein the knee of the user has a kneeling shape when the user is kneeling, said pad comprising:

a) a first layer; and b) a second layer;

wherein said first layer is attached to said second layer;

wherein said first layer is for providing comfort for the knee of the user during kneeling; and wherein said second layer is a sheet of metallic foil so as to allow said disposable, single use, and shape-retaining pad to maintain the kneeling shape of the knee of the user after the user has kneeled to prevent said disposable, single use, and shape-retaining pad from popping back and off the knee of the user when the user is no longer kneeling.

2. The pad of claim 1, wherein said first layer is attached to said second layer by a first layer of adhesive.

3. The pad of claim 2, wherein said second layer has a second layer of adhesive thereon; and wherein said second layer of adhesive is for releasably attaching said disposable, single use, and shape-retaining pad to the knee of the user.

4. The pad of claim 3, wherein said second layer of adhesive is on a side of said second layer, which is opposite to that of said first layer of adhesive.

5. The pad of claim 3, wherein said second layer of adhesive is covered by a release sheet;

wherein said release sheet protects said second layer of adhesive prior to use of said disposable, single use, and shape-retaining pad; and wherein said release sheet peels off said second layer of adhesive when said disposable, single use, and shape-retaining pad is to be used.

6. The pad of claim 5, wherein said release sheet is a single sheet.

7. The pad of claim 5, wherein said release sheet is a roll to allow multiple disposable, single use, and shape-retaining pads to share the same roll.

8. The pad of claim 7, wherein said roll of said release sheet is provide with weakened tear off lines thereacross to allow each individual disposable, single use, and shape-retaining pad to be torn off said roll as needed.

9. The pad of claim 1, wherein said first layer is a sheet of foam material.

* * * * *